US007667193B2

(12) United States Patent
Finlay

(10) Patent No.: US 7,667,193 B2
(45) Date of Patent: Feb. 23, 2010

(54) PERSONALISED MASS SPECTROMETER

(75) Inventor: Alan Finlay, Richmond (GB)

(73) Assignee: Microsaic Systems Limited, Woking, Surrey (GB)

( * ) Notice: Subject to any disclaimer, the term of this patent is extended or adjusted under 35 U.S.C. 154(b) by 380 days.

(21) Appl. No.: 11/711,142

(22) Filed: Feb. 26, 2007

(65) Prior Publication Data

US 2008/0073510 A1 Mar. 27, 2008

(30) Foreign Application Priority Data

Mar. 2, 2006 (GB) ..... 0604186.7

(51) Int. Cl.
*H01J 49/00* (2006.01)
*H01J 49/02* (2006.01)

(52) U.S. Cl. ..... 250/281; 250/282

(58) Field of Classification Search ..... 250/281, 250/282, 283, 288, 299, 284, 287; 702/22, 702/23, 24, 25, 26, 27, 28, 29, 31, 32
See application file for complete search history.

(56) References Cited

U.S. PATENT DOCUMENTS 3,471,691 A 10/1969 Gielow et al.
4,898,831 A * 2/1990 Smith ..... 436/32
5,557,544 A * 9/1996 Simon et al. ..... 702/77
6,025,591 A 2/2000 Taylor et al.
6,420,699 B1 * 7/2002 Herschbach et al. ..... 250/251
2003/0109990 A1 * 6/2003 Axelsson ..... 702/27
2005/0017166 A1 * 1/2005 Scheidemann et al. ..... 250/288
2005/0199805 A1 * 9/2005 Freidhoff ..... 250/294
2007/0026426 A1 * 2/2007 Fuernkranz et al. ..... 435/6
2007/0029477 A1 * 2/2007 Miller et al. ..... 250/290
2007/0096023 A1 * 5/2007 Freidhoff ..... 250/294
2007/0158542 A1 * 7/2007 Bauer et al. ..... 250/282
2008/0034219 A1 * 2/2008 Ting ..... 713/186

FOREIGN PATENT DOCUMENTS

EP 0 644 576 A2 3/1995
EP 0793255 * 9/1997
GB 1082819 9/1967
GB 2378755 A 2/2003
GB 2384908 A 8/2003
GB 2391694 A 2/2004
GB 2411046 A 8/2005

* cited by examiner

*Primary Examiner*—Jack I Berman
*Assistant Examiner*—Nicole Ippolito Rausch
(74) *Attorney, Agent, or Firm*—Bishop & Diehl, Ltd.

(57) ABSTRACT

A personalized mass spectrometer system is described. By fabricating analyzer components on a module and including with that module an identifier for that module, it is possible to uniquely associate a user or task with one or more modules. The module is removably receivable within a housing and can be replaced with another module if so required.

34 Claims, 3 Drawing Sheets

PERSONALISED MASS SPECTROMETER

CROSS-REFERENCE TO RELATED APPLICATIONS

This application claims priority to United Kingdom Patent Application No. GB0604186.7, filed Mar. 2, 2006, which is expressly incorporated herein by reference and made a part hereof.

FEDERALLY SPONSORED RESEARCH OR DEVELOPMENT

Not applicable.

TECHNICAL FIELD

The present invention relates to mass spectrometry and in particular to mass spectrometers provided using hybrid integration techniques. The invention more particularly relates to a mass spectrometer that may be uniquely associated with a user or apparatus

BACKGROUND OF THE INVENTION

Mass spectrometry (MS) is a powerful analytical technique that is used for the qualitative and quantitative identification of organic molecules, peptides, proteins and nucleic acids. MS offers speed, accuracy and high sensitivity.

Key components of a mass spectrometer are the ion source, ion coupling optics, mass analyser and detector. The ion source transforms analyte molecules into a stream of charged particles, or ions, through a process of electron addition or subtraction. The ions can be 'steered' using electric or magnetic fields. Ion coupling optics or lenses collimate the ion flux from the ion source into the mass analyser. The analyser separates ions by their mass to charge ratio. Several different kinds of mass analyser are known in the art, including, but not limited to; magnetic sector, quadrupole, ion trap, time of flight and cycloidal. The ions exit the analyser in order of mass to charge ratio and in so doing produces a mass spectrum which is a unique signature or 'fingerprint' for the analyte. Ions are directed to a detector where they impact and discharge an ion current which may be counted and amplified by signal electronics before being displayed on a computer screen as a mass spectrum. The detector is normally an electron multiplier. These components together form the analytical sub-system of the mass spectrometer system.

Until recently, these mass spectrometer components have been manufactured using conventional engineering techniques such as machine tools. This technology has been the mainstay of the mass spectrometer industry and is the basis of almost all products on market. Several attempts have been made to miniaturise and integrate these components using silicon micromachining, or MEMS technology, some of which are described in our previously filed British applications, GB 0202665.6 and GB 0217815.0. The principle advantages of miniaturised mass analysers are the significantly reduced system requirements, in particular smaller power supplies, electronics and vacuum systems, an example of which is described in our earlier application, GB 0403122.5. This dividend is a consequence of the scaling laws associated with geometrically reduced electrical fields, and the shorter mean free path between collisions of molecules.

Other mass spectrometer system components include vacuum pumps, a vacuum chamber, drive electronics, data acquisition electronics, power supplies and enclosures.

As mentioned above, conventional mass spectrometer components are manufactured and assembled using machine tools and other workshop practices. Because mechanical precision is critical to the final performance of the mass spectrometer, these parts are fixed in place and are normally only dismantled, cleaned and re-assembled by a trained technician using proprietary tooling. Periodic cleaning of the mass analyser, ion optics and ion source is necessary because of a build-up of residual sample coatings during prolonged operation. These residues cause 'clogging' of apertures, deteriorating performance and cross-contamination of samples. Regular preventative maintenance is also needed to avoid burn-out of certain parts with a definite lifetime like the filaments and electron multiplying detectors. The entire maintenance and cleaning process can take several days to fully dismantle, clean, re-assemble and, if necessary replace, the core components and to pump down the system to full vacuum. This 'downtime' has a substantial impact on the availability, research chemist productivity and overall cost of ownership of this expensive asset.

There is therefore a need to provide an improved mass spectrometry system that overcomes these and other disadvantages associated with the prior art.

SUMMARY OF THE INVENTION

Accordingly the teaching of the invention provides a multi-chip module based integrated solution that enables revolutionary modes of system operation and maintenance. Using the teaching of the invention, a module based mass spectrometer may be manufactured in batches on printed circuit boards or the like at high volumes and relatively low cost. These economies of scale open up the possibility of an interchangeable, consumable or even disposable mass spectrometer module. By providing a taggable removable module that interfaces with a housing, it is possible to associate the removable element of the mass spectrometer system with a specific user or application and then to subsequently trace analysis performed on that module to that user or application.

In a first embodiment there is provided a mass spectrometer system comprising a removable mass detector module and a housing, the module being configured to mate and interface with the housing, and wherein the module includes a mass analyser and a readable identifier, the identifier serving to distinguish the module from other modules, and wherein the housing includes a reader configured, on an interfacing of the module with the housing, to effect communication with the readable identifier such that mass analysis effected using the module may be traced to the module.

Each of the module and the housing may include a communication interface configured, on a mating of the module and the housing, to enable electronic coupling between the housing and the interface. Such coupling may be provided to enable a transfer of power or communications between the housing and the module.

The system typically includes an ion source, a detector and ion coupling optics. These may be provided within the physical structure of the housing or as components of the module. Typically, at least the detector, which is optionally an ion counter, is provided on the removable module. In a preferred application, the coupling optics are typically also provided on the removable module.

For performance reasons, the ion optics, mass analyser and detector are typically provided within a vacuum chamber. Optionally, the ion source is also provided within a vacuum chamber.

The removable module may include at least one alignment feature, the at least one alignment feature enabling an alignment of the separate components of the module relative to one another. Typically the module is provided on a printed circuit board.

Depending on the specific implementation of the system, the identifier is normally selected from at least one of:

A RFID tag,

A bar code.

A memory device or datastore

The reader provided in the housing is normally selected from the type fabricated from an electronic or optical reader.

In implementations where the identifier is a memory device or datastore, the reader may effects communication with the memory device or datastore so as to identify the module. Such communication may provide for an interrogation of the memory device or datastore once the module is interfaced with the housing. The reader may also be provided with write capability and in such embodiments, the reader may be configured to effect a writing to the memory device or datastore.

In such writing embodiments, wherein the reader is configured to effect a writing of data relating to the analysis effected on the system to the module, the module may be configured to combine in a datastore provided on the module, details of the components used to effect the analysis with results from that analysis.

The module may includes an outer shell, and is typically interfaced with the housing by means of a demountable connection, such as a push-fit connection.

The housing typically includes support elements such as vacuum pumps, electronics and power supplies for operation of the module. To provide for further functionality of the system, the housing may includes a datastore, the datastore including a set of predefined operating parameters for operation of a specific module, the correct operating parameters being applied on reading of the module identifier by the reader.

To enable a geographic locating of the module, either for traceability of location retrieval, the module may further include a GPS chip-set, the GPS chip-set enabling a geographic locating of the module.

The module may further includes at least one of a pressure and temperature sensor. By providing such sensors it is possible to record the climatic operating conditions prevalent at the time of analysis. Such data is important for subsequently comparing results effected at different times or locations.

As the module is easily transportable between one location and another, the module may further include an accelerometer, the accelerometer being configured to sense damage arising from impact or vibration of the module.

The system may further include a memory device, the memory device being configured to store data resulting from mass spectrometry analysis effected using the module. Such storage may typically be effected using a permanent memory store physically located on either the housing or removable module. In addition a memory device may be provided as a removable element, such as a USB memory stick, that could be used to retrieve data from the system for analysis in a second location. The system could include other transport protocols such as Local Area Network (LAN) or Wide Area Network (WAN) protocols that enable the system to be interfaced within a computer network architecture through either a wired or wireless medium.

The system may further including an audit module, the audit module being configured to effect an association and storage of specific users of the system with specific modules used with the system. Such an audit module is typically implemented using software functionality, with physical storage being provided on storage devices.

The system may include a plurality of modules which may be sequentially used with the system, each of the modules having an identifier provided thereon so as to enable a subsequent distinguishing of analysis conducted using a first module from that conducted using a second module. The system is typically implemented using low cost mass production techniques such as those achieved by fabrication of the module using MEMS technology. These and other features of the invention will be described with reference to the exemplary embodiments which follow.

BRIEF DESCRIPTION OF THE DRAWINGS

The present invention will now be described with reference to the accompanying drawings in which.

DETAILED DESCRIPTION

Figure 1:
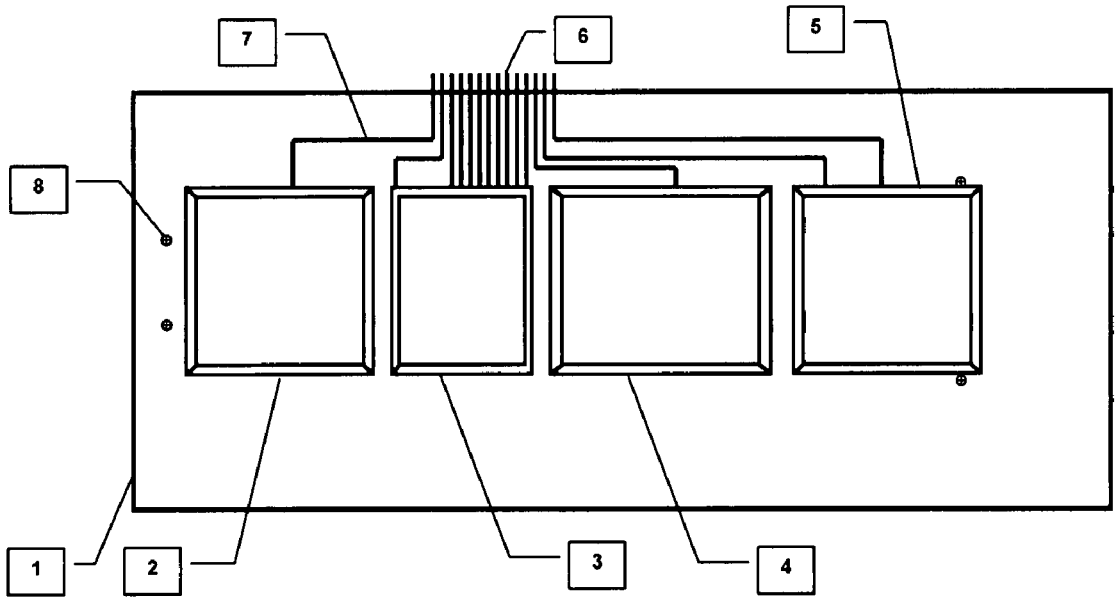
FIG. 1 is a plan view of functional components of mass spectrometry system in accordance with the teaching of the present invention.

The invention will now be described with reference to FIGS. 1 to 5.

In accordance with the teaching of the invention, one or more key mass spectrometer components are mounted onto a submount (1) such as a printed circuit board. In the exemplary embodiment shown in FIG. 1, a plurality of these components, specifically an ion source (2), ion coupling optics (3), mass analyser (4), electron multiplying detector (5) and connector (6), or some combination of these parts, are combined to form a robust, interchangeable mass spectrometer module. In the case where atmospheric pressure ionisation is used, the ion source (2) would be outside the vacuum chamber and potentially left off the module. Other embodiments may be implemented with all but the analyser component off the module. Tracks (7) provide electrical connectivity and alignment features (8) permit rapid, accurate and reproducible assembly.

Figure 2:
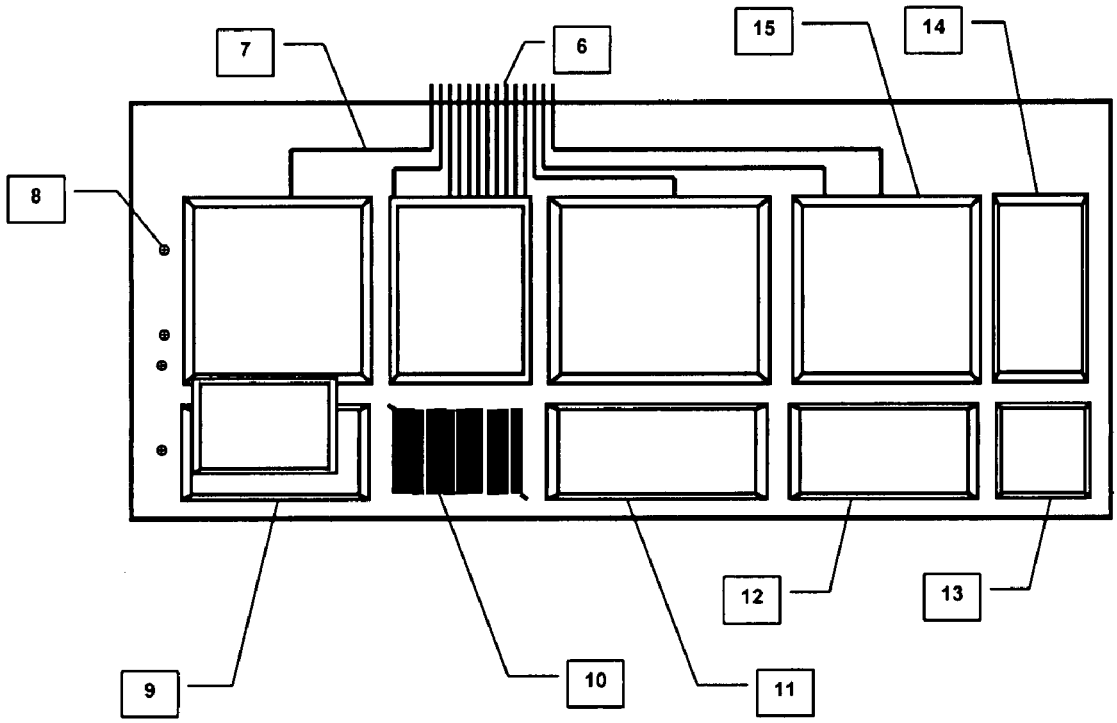
FIG. 2 is a plan view showing a modification of the system of FIG. 1 to include additional components.

As shown in FIG. 2, the functionality of the mass spectrometer module may be enhanced by integrating multiple microelectronic or other components onto the same mounting. Additional components could include, but are not limited to, RFID tags (9), barcode (10), GPS chip-set (11), memory chips (12), temperature sensor (13), pressure transducers (14) and accelerometers (15). In this way the module could be a functionally rich, personalised mass spectrometer. These functions could be important in complying with FDA regulations and its Process Analytical Technology (PAT) initiative.

Figure 3:
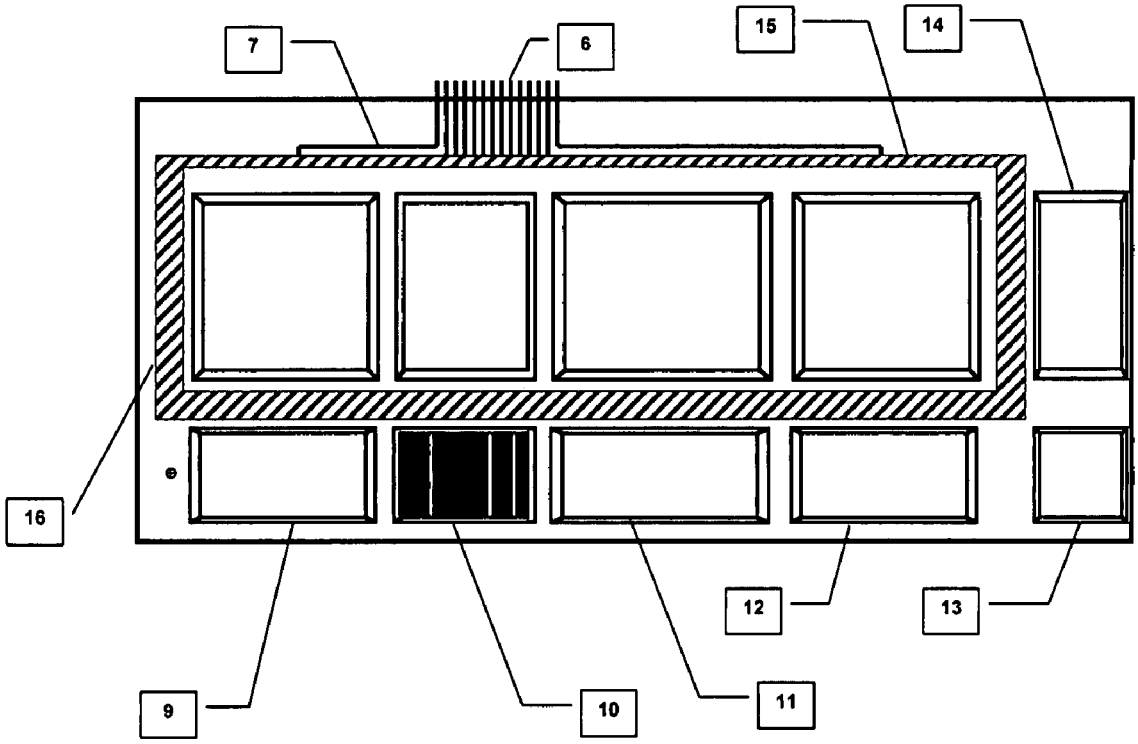
FIG. 3 is a plan view of a modification of the system of FIG. 2 to show the inclusion of a vacuum chamber.
Figure 4:
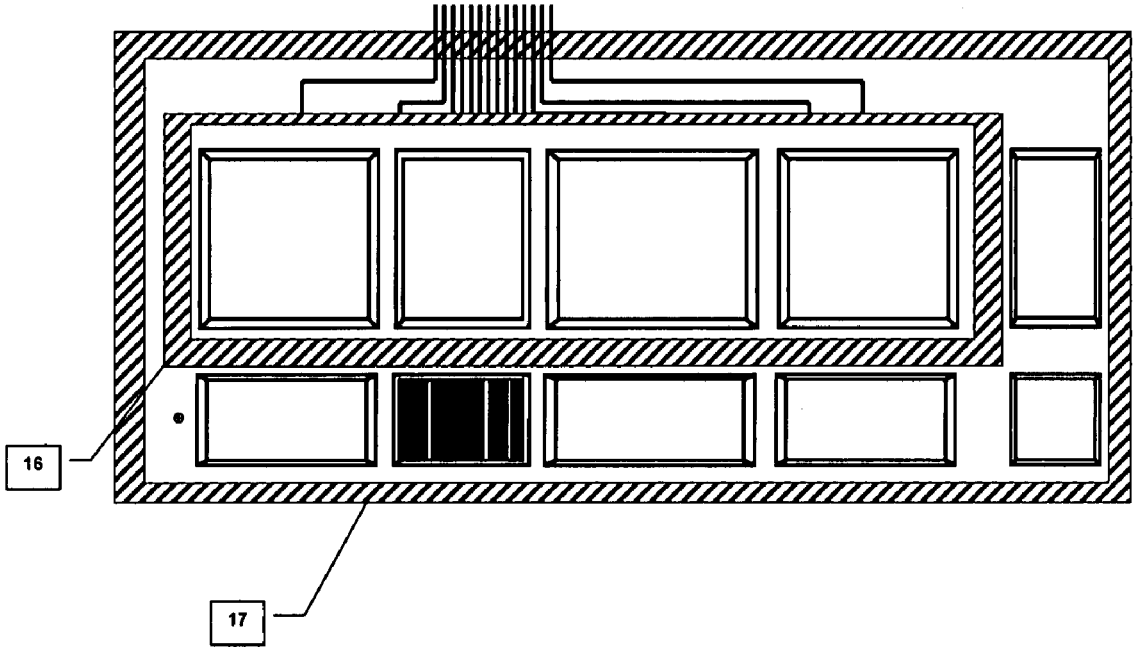
FIG. 4 is a plan view of a modification of the system of FIG. 3 to incorporate an outer shell.
Figure 5:
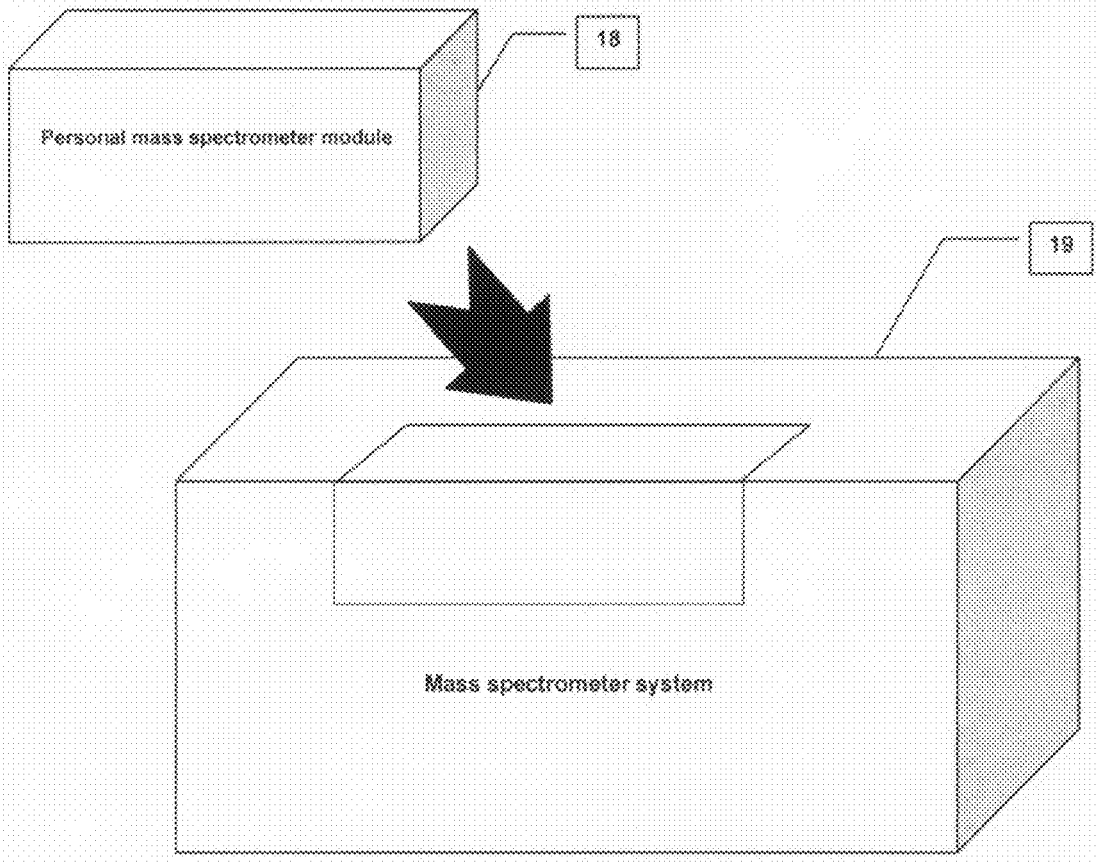
FIG. 5 is a schematic showing the insertion of a system of FIG. 4 into a housing.

For reasons of outgassing it may be undesirable to mount these microelectronic components inside the vacuum chamber. Alternatively, as shown in FIG. 3, these components could be mounted outside, or on the outside surface of, the vacuum chamber (16). In this embodiment the module incorporates some parts, or all of, a vacuum chamber.

These components may be hybrid integrated onto a submount, substrate or printed circuit board (PCB) using multi-chip module (MCM), through-hole or surface-mount technology. Alternatively it may be possible to monolithically integrate these components onto the mass spectrometer module.

This module could be provided with an outer shell (17), manufactured from injection moulded plastic, ceramic, metal extrusion or folded sheet metal, and capable of being easily inserted into, or coupled to, the mass spectrometer system and self-aligned by a user by means of a push-fit or some similar demountable fit connector arrangement such as for example twist fit, clip-on etc. Inside this shell, vacuum chamber parts could be mounted along with a submount, PCB or substrate supporting outgassing integrated circuits such as the RFID tags (9), barcode (10), GPS chip-set (11), memory chips (12), temperature sensor (13), pressure transducers (14) and accelerometers (15). Inside the vacuum chamber (16) the ion source (2), ion coupling optics (3), mass analyser (4), electron multiplying detector (5), connectors (6), or some combination of these parts, tracks (7) and alignment features (8) could be mounted on a second, submount or PCB manufacturing from some vacuum compatible, non-outgassing material such as ceramic. Of course, as will be appreciated by those skilled in the art, it is not necessary for all parts to be provided within a vacuum arrangement as some will operate equally efficiently outside or inside vacuum conditions.

The personal mass spectrometer module (18) is inserted into the mass spectrometer system (19) which is typically dimensioned similarly to a laptop-sized unit and provides a housing for the various support elements required to operate the mass analyser such as vacuum pumps, intermediate vacuum chambers, drive electronics, data acquisition electronics, power supplies and enclosures. By separating the functionality of the operational components of the mass spectrometry—the ion source, ion coupling optics, mass analyser, electron multiplying detector into a first module, and the support functionality of the mass spectrometry—the vacuum pumps, intermediate vacuum chambers, drive electronics, data acquisition electronics, power supplies and enclosures into a second module, it is possible to provide an improved system to that heretofore available to users. The first module is interfaceable with the second module, but as it may be removed, it is possible to provide two or more such first modules that may be sequentially used with the second module. In this way, when the operational components need cleaning, replacing etc., it is possible to simply extract the first module and replace it with another of the same type. In this way the down time of the system is reduced. Furthermore, as the first module may be fabricated using low cost mass production techniques, such as those that may be implemented using MEMS techniques, it is feasible to consider that it may be used as a disposable unit—thereby obviating the need to clean at any stage.

It will be understood that what has been described here is a mass spectrometer provided on an interchangeable module. By providing such a module, it is possible to provide the user of the system with a personalised mass spectrometer module. This, it will be appreciated provides a plurality of advantages for different applications. In the chemical environment for example, every chemist could have a set of personally tagged modules, exclusively for his or her use. Each module could record an audit-trial of when, how and by whom it was used and save date-stamped mass spectra in memory. A RFID device or some other suitable recognition tag would allow the system to wirelessly recognise the module once inserted into the system, and automatically activate personalised user interfaces, preferences and operating settings. The barcode could provide a similar 'labelling' function to the RFID tag at a lower cost and with legacy technology. The GPS chip-set would allow users to locate a module at any given time, and to track its movement and use inside and between systems. Supply chain and logistic functions may also be implemented in this way. The temperature sensor and pressure transducer could deliver information on operating parameters—important in self-test and self-diagnostics functions. Accelerometers could track failure modes and damage arising from impact or vibration during handling and use. Again this information would allow the system to interrogate the module during calibration and self-test.

Ultimately these functions could permit an analyser module to be archived after use and interrogated at some later date, for example during pre-clinical trials or regulatory compliance processes. The addition of these functions will permit users to exploit a personal mass spectrometer module as a 'virtual laboratory notebook'. This would have the further advantage of eliminating any errors in record-keeping, data transfer, and reduces the possibility of falsification of scientific results. Although the application has been described specifically with reference to a user specific module, it will be appreciated that other applications may provide for an association of a module with a specific application or task. In this way the specific tagged module is linked to a specific analysis technique or task, irrespective of the user that conducts the analysis. Later interrogation of a module will show the task performed using that module.

Further tagging could provide for a registration of each of the multiple users who were responsible for the sequential analysis steps to be linked to each of the task. Such registration could be provided for example by using simple password and login techniques before operation of the system may be initiated or indeed by using biometric capture devices and associated a captured identifier with a specific application.

Although the invention has been described with reference to specific figures and embodiments, it will be understood that these are provided as 10 exemplary embodiments of the type of arrangement that could be used in the implementation of the teaching of the invention. Furthermore, it will be understood that specific Figures illustrate specific components to describe applications of the invention but that these specific components should not be considered essential to the invention except as may be deemed necessary in the light of the appended claims. Where components of a first type are described with reference to a specific figure, it will be understood that these could be interchanged for components of another type without departing from the scope of the invention. It will also be understood that components described with reference to a first figure may be interchanged with those of another figure.

The words comprises/comprising when used in this specification are to specify the presence of stated features, integers, steps or components but does not preclude the presence or addition of one or more other features, integers, steps, components or groups thereof.

What is claimed is:

1. A mass spectrometer system for providing a mass analysis of a sample, the system comprising a removable mass detector module and a housing, the module being configured to mate and interface with the housing, and wherein the module includes a mass analyser and a readable identifier, the identifier serving to distinguish the module from other modules, and wherein the housing includes a reader configured, on an interfacing of the module with the housing, to effect communication with the readable identifier such that mass analysis of the sample effected using the module may be traced to and associated with the module.

2. The system as claimed in claim 1 wherein each of the module and the housing include a communication interface configured, on a mating of the module and the housing, to enable electronic coupling between the housing and the interface.

3. The system as claimed in any claim 1 wherein the system includes an ion source, a detector and ion coupling optics.

4. The system as claimed in claim 3 wherein at least the detector is provided on the removable module.

5. The system as claimed in claim 3 wherein the detector is an ion counter.

6. The system as claimed in claim 3 wherein at least the detector and coupling optics are provided on the removable module.

7. The system as claimed in claim 6 wherein the ion optics, mass analyser and detector are provided within a vacuum chamber.

8. The system as claimed in claim 1 further including an ion source.

9. The system as claimed in claim 8 wherein the ion source is provided within a vacuum chamber.

10. The system as claimed in claim 1 wherein the removable module includes at least one alignment feature, the at least one alignment feature enabling an alignment of the separate components of the module relative to one another.

11. The system as claimed in claim 1 wherein the module is provided on a printed circuit board.

12. The system as claimed in claim 1 wherein the identifier is selected from at least one of:

a. A RFID tag, b. A bar code, c. A memory device or datastore.

13. The system as claimed in claim 1 wherein the reader is an electronic or optical reader.

14. The system as claimed in claim 12 wherein the identifier is a memory device or datastore and the reader effects communication with the memory device or datastore so as to identify the module.

15. The system as claimed in claim 14 wherein the reader is configured to effect an interrogation of the memory device or datastore once the module is interfaced with the housing.

16. The system as claimed in claim 15 wherein the reader is configured to effect a writing to the memory device or datastore.

17. The system as claimed in claim 16 wherein the reader is configured to effect a writing of data relating to the analysis effected on the system to the module, such that the module combines in a datastore the components used to effect the analysis with results from that analysis.

18. The system as claimed in claim 1 wherein the module includes an outer shell, and wherein the module is interfaced with the housing by means of a demountable connection.

19. The system as claimed in claim 1 wherein the housing includes support elements for operation of the module.

20. The system as claimed in claim 1 wherein the housing includes a datastore, the datastore including a set of predefined operating parameters for operation of a specific module, the correct operating parameters being applied on reading of the module identifier by the reader.

21. The system as claimed in claim 1 wherein the module further includes a GPS chip-set, the GPS chip-set enabling a geographic locating of the module.

22. The system as claimed in claim 1 wherein the module further includes at least one of a pressure and temperature sensor.

23. The system as claimed in claim 1 wherein the module further includes an accelerometer, the accelerometer being configured to sense damage arising from impact or vibration of the module.

24. The system as claimed in claim 1 further including a memory device, the memory device being configured to store data resulting from mass spectrometry analysis effected using the module.

25. The system as claimed in claim 1 further including an audit module, the audit module being configured to effect an association and storage of specific users of the system with specific modules used with the system.

26. The system as claimed in claim 1 wherein a plurality of modules may be sequentially used with the system, each of the modules having an identifier provided thereon so as to enable a subsequent distinguishing of analysis conducted using a first module from that conducted using a second module.

27. The system as claimed in claim 1 wherein the module is fabricated using MEMS technology.

28. The system as claimed in claim 1 further including communication means configured to enable an interface of the system within a computer network architecture such that information may be interchanged between the system and computer systems elsewhere in the architecture.

29. The system as claimed in claim 1 further including a removable mass storage device.

30. A housing for use in a mass spectrometer system, the system being configured for providing a mass analysis of a sample, the system including the housing and a removable module, the removable module including a mass analyser and a readable identifier, the housing having a machine readable reader provided therein and being configured, in use, to receive and interface with the removable mass detector module, and wherein on an interfacing of the module with the housing, the reader is configured to effect communication with the readable identifier such that mass analysis of the sample effected using the module may be traced to and associated with the module.

31. A removable mass analysis module for use in a mass spectrometer system, the system being configured for providing a mass analysis of a sample, the system including the module and a housing for the module, the housing having a reader provided therein and being configured to receive and interface with the module, and wherein the module includes a mass analyser and a readable identifier, such that in use an interface of the module with the housing enables a communication between the module readable identifier and the housing reader, such that mass analysis of the sample effected using the module may be traced to and associated with the module.

32. A method of providing a personalised mass spectrometer system to provide for mass analysis of a sample, the method comprising:

a. Providing an analyser module, the module having formed thereon a mass analyser, the module further having further formed thereon a readable identifier, the identifier serving to distinguish the module from other modules, b. Providing a housing, the housing being configured to receive and mate with the module, the housing having a reader configured to communicate with the identifier, c. Using the system to perform a mass analysis of the sample and on performing the mass analysis of the sample associating the mass analysis with the module used to perform the mass analysis.

33. The method as claimed in claim 32 further including interfacing the module with a housing, the housing having electronics components provided therein, which on interface of the module with the housing provide for operation of the module.

34. The method as claimed in claim 33 further including, on determining the identification of the module interfaced with the housing, of effecting appropriate operating parameters for that module dependent on the identification of the module.

* * * * *